US011825897B2

(12) United States Patent
Knies et al.

(10) Patent No.: US 11,825,897 B2
(45) Date of Patent: Nov. 28, 2023

(54) COMPONENT FOR ESTABLISHING ELECTRICAL CONTACT BETWEEN AT LEAST ONE FUNCTIONAL ELEMENT AND A TEXTILE OR THE LIKE AND ASSEMBLY COMPRISING A COMPONENT

(71) Applicant: Robert Bosch GmbH, Stuttgart (DE)

(72) Inventors: Sonja Knies, Rutesheim (DE); Philipp Scheiner, Weil der Stadt (DE); Rainer Holz, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/772,733

(22) PCT Filed: Sep. 23, 2020

(86) PCT No.: PCT/EP2020/076546
§ 371 (c)(1),
(2) Date: Apr. 28, 2022

(87) PCT Pub. No.: WO2021/089227
PCT Pub. Date: May 14, 2021

(65) Prior Publication Data

US 2022/0338572 A1 Oct. 27, 2022

(30) Foreign Application Priority Data

Nov. 8, 2019 (DE) ..... 10 2019 217 290.3

(51) Int. Cl.
*A41D 27/08* (2006.01)
*A44B 17/00* (2006.01)
*F21V 33/00* (2006.01)

(52) U.S. Cl.
CPC ..... *A41D 27/085* (2013.01); *A44B 17/0064* (2013.01); *F21V 33/0008* (2013.01)

(58) Field of Classification Search
CPC ..... A41D 27/085; A44B 17/0064; A44B 17/0082; F21V 33/0008
(Continued)

(56) References Cited

U.S. PATENT DOCUMENTS 5,440,461 A * 8/1995 Nadel ..... F21V 19/0005 362/800
9,445,641 B1 9/2016 Rapisarda
(Continued)

FOREIGN PATENT DOCUMENTS

DE 102006008796 B3 12/2007
DE 202013105122 U1 1/2014
(Continued)

OTHER PUBLICATIONS

International Search Report for PCT/EP2020/076546, dated Nov. 16, 2020.

*Primary Examiner* — Laura K Tso
(74) *Attorney, Agent, or Firm* — NORTON ROSE FULBRIGHT US LLP; Gerard Messina

(57) ABSTRACT

A component for establishing electrical contact between at least one functional element and a textile or the like. The component includes a main body, which accommodates at least one electrical component and/or one functional element, and includes connection elements for establishing electrical contact with electrically conductive regions of the textile or the like.

15 Claims, 4 Drawing Sheets

(58) Field of Classification Search
USPC ..... 362/103, 234, 253, 656
See application file for complete search history.

(56) References Cited

U.S. PATENT DOCUMENTS

| | | | | |
|---|---|---|---|---|
| 2015/0164183 | A1* | 6/2015 | Chen | A44B 1/04 362/103 |
| 2015/0170480 | A1* | 6/2015 | Chen | F21V 33/0008 362/396 |

FOREIGN PATENT DOCUMENTS

| | | | |
|---|---|---|---|
| DE | 102016224565 | A1 | 6/2018 |
| GB | 2487755 | A | 8/2012 |

* cited by examiner

COMPONENT FOR ESTABLISHING ELECTRICAL CONTACT BETWEEN AT LEAST ONE FUNCTIONAL ELEMENT AND A TEXTILE OR THE LIKE AND ASSEMBLY COMPRISING A COMPONENT

FIELD

The present invention relates to a component for establishing electrical contact between at least one functional element and a textile or the like. The present invention further relates to an assembly comprising a component formed in accordance with the present invention and a textile or the like having electrically conductive regions.

BACKGROUND INFORMATION

A component for establishing electrical contact between at least one functional element and a textile or the like is described in German Patent Application No. DE 10 2006 008 796 B3. This conventional component is in the form of a pushbutton, the pushbutton simultaneously being used as a support for or to accommodate an electronic part or the like that is a component part of the functional element. The electronic part has (electrical) connection elements in the form of wires, which protrude out of the underside of the component and are for example connected, in a manner not described in more detail, to a part of the textile that is formed as an electrically conductive yarn.

SUMMARY

A component according to the present invention for establishing electrical contact between at least one functional element and a textile or the like may have the advantage whereby it allows for particularly simple yet reliable electrical contact with the electrically conductive regions of the textile or the like. The present invention is based on the notion of configuring the (electrical) connection elements on the component in such a way that, when the component is connected to the textile or the like, said connection elements simultaneously establish reliable electrical contact with the electrically conductive regions of the textile or the like. In particular, apart from connecting the component to the textile or the like, no subsequent, additional work steps are required in order to create the electrical connection on the textile or the like. In particular, no soldering steps, welding steps, or similar additional work steps are required in order to connect the electrical connection elements of the component to the electrically conductive regions of the textile or the like.

In accordance with an example embodiment of the present invention, the connection elements of the component are configured such that, when the main body of the component is connected to the textile or the like, they create an electrical connection to the electrically conductive regions of the textile or the like by a frictional and/or interlocking connection. The connection elements on the component are formed such that, when the component is fastened to the textile or the like, the connection elements are pressed, or forced, against the electrically conductive regions of the textile or the like and thus create the electrical connection. Particularly to compensate for tolerances in relation to the arrangement of the electrically conductive regions in or on the textile or the like, it is advantageous if, in the process, the electrical connection elements of the component are forced in the direction of the electrically conductive regions of the textile or the like under resilient preloading.

Advantageous developments of the component according to the present invention for establishing electrical contact between at least one functional element and a textile or the like are disclosed herein.

In a preferred structural configuration of the main body of the component, the main body has through-openings for guiding or accommodating the connection elements, the connection elements possibly protruding out of the through-openings on an underside of the main body of the component. As a result, it is possible to arrange the underside of the main body in abutment with the textile or the like, the electrical connection elements reaching as far as the level of the electrically conductive regions of the textile or the like, or frictionally abutting them there.

In a development of the present invention, it is provided that the connection elements have at least one element which is configured to generate a resilient preload force in the direction of the electrically conductive regions of the textile or the like. For example, the electrical connection elements are in the form of pin-like metal parts which interact with spring elements that create the required preload force in the direction of the electrically conductive regions of the textile or the like. It is also possible that the spring element, as the sole element, forms the electrical connection element. Since the connection elements are arranged in the through-openings in the main body, the connection elements are also able to move in their longitudinal direction within the through-openings. For this purpose, preferably (only) a small radial clearance or a small radial gap is formed between the connection elements and the through-openings.

To be able to adapt the component in a simple manner to as many different requirements or functionalities as possible, and to allow for a kind of modular system, a further preferred configuration of the component provides that the main body has a preferably plate-like basic part, which in particular has a round cross-section and consists of electrically non-conductive material and the top side of which is covered by a cap-like closure part, the closure part preferably being connected to the basic part by way of a snap-in connection.

In a development of this proposal in accordance with an example embodiment of the present invention, it is provided that a seat for arranging at least one electrical and/or electronic component and/or the functional element is preferably formed in the closure part. The modular system is then made possible in that, for example, one and the same basic part can be connected to different closure parts having accordingly formed seats for a wide range of applications or components and/or functional elements.

In a specific application that makes it possible to implement a lighting element as a functional element on the textile or the like, the closure part is made of transparent plastics material, and a lighting element, preferably an LED, is arranged in the main body.

There are also various options for fastening the component to the surface of the textile or the like. In accordance with an example embodiment of the present invention, in a first, preferred configuration, it is provided that the main body forms the top part of a pushbutton, which top part can be connected to a bottom part of the pushbutton while forming a snap-in connection, wherein, in the latched state, a gap for securing the textile or the like having the electrically conductive regions is formed between the top part and the bottom part. A configuration of this kind makes it possible to fasten the component to the textile or the like in a particularly simple manner either manually or automatically. In addition, it is particularly simple, for example, to replace the component on the textile or the like, for example in the event of a fault.

However, it is also possible to omit a bottom part or to forgo forming a pushbutton. In this case, it is provided that the main body of the component is configured to be connected to the textile or the like having the electrically conductive regions by way of an integral bond. An integral bond of this kind can be created, for example, in the form of an adhesive, or alternatively in the form of a layer of solder, if the electrically conductive regions are positioned directly on the surface of the textile or the like.

In addition, the present invention comprises an assembly comprising a component according to the present invention as described thus far, and a textile or the like having electrically conductive regions, contact being established with the electrically conductive regions by a frictional or interlocking connection by way of the connection elements of the component.

Furthermore, the assembly also includes a configuration in which the conductive regions are arranged in the textile or the like in different planes and at different distances from the main body of the component.

To allow the component to also be suitable for having a relatively complex functionality that usually requires different electrically conductive regions on the textile or the like, in a further configuration of the assembly the electrically conductive regions of the textile or the like are connected to contact sites or are formed as contact sites that interact with the connection elements of the component, and the contact sites are of different lengths such that the contact sites on the side facing the component terminate in a shared plane.

Furthermore, it can be provided that electrically conductive regions are arranged on the surface of the textile or the like that faces the main body, and that said electrically conductive regions are connected to the main body of the component by way of an electrically conductive adhesive or a layer of solder.

Up to now, the component described thus far has been described in particular in conjunction with a textile. By way of example, a textile should be understood as functional wear or protective work clothing that has, for example, lighting elements, sensor elements, or the like as functional elements. However, the present invention is not intended to be limited to such applications. Rather, the component can be used on items of clothing of any kind. It can also be provided that the component is a component part of printed circuit boards, for example inter-module connections or the like, which are conventional. Applications in the area of vehicle bodywork, for example components of passenger compartments in motor vehicles, are also possible. By way of example, there are further applications in buildings in the area of fire alarms, smart home sensors, or the like. Furthermore, applications in the area of sports equipment such as bicycles, e-bikes, skis, or the like are also possible, as well as in the area of measurement equipment.

Further advantages, features, and details of present invention become apparent from the following description of preferred exemplary embodiments and on the basis of the figures.

DETAILED DESCRIPTION OF EXAMPLE EMBODIMENTS

Figure 1:
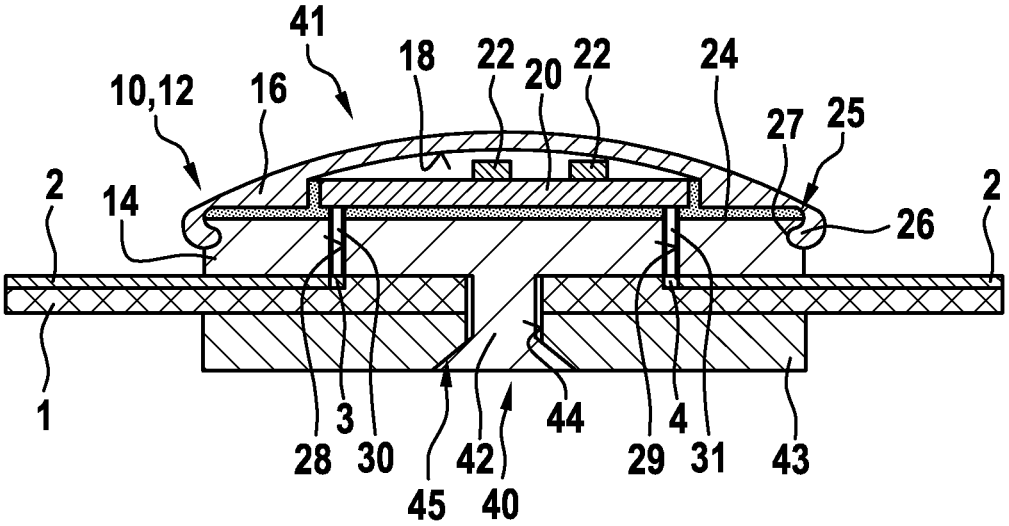
FIG. 1 is a simplified section through a first specific example embodiment of a component that is connected to a textile as a component part of a pushbutton, in accordance with the present invention.

Identical elements or elements having the same function are provided with the same reference numerals in the figures.

FIG. 1 shows a first component 10 for establishing electrical contact between at least one functional element and a textile 1. By way of example, the textile 1 can be an item of clothing such as a jacket, protective work clothing, or the like. However, the present invention is not intended to be limited to wearable textiles 1. Rather, any other functional support made of a flexible material, such as a flexible printed circuit board, can also be provided instead of the textile 1. Other applications of the present invention are also possible, for example for so-called flat printed circuit boards such as inter-module connections, components of passenger compartments in motor vehicles, parts of buildings such as fire alarms and smart home sensors, sports equipment such as bicycles and skis, measurement equipment, or the like.

The component 10 has a main body 12, which consists of a basic part 14 and a cap-like closure part 16 connected to the basic part 14. The basic part 14 is plate-like and has a round cross-section, for example. The basic part 14 consists of an electrically non-conductive plastics material, the closure part 16 covering the top side of the basic part 14 facing away from the textile 1. The closure part 16 likewise consists of plastics material and has a seat 18 in which, for example, a circuit board 20 or a substrate is arranged as a functional element on which electronic parts 22 are arranged. By way of example, the circuit board 20 is enclosed by a mold compound 24 at least in some regions within the seat 18. The closure part 16 is connected to the basic part 14 by way of a snap-in connection 25. The snap-in connection 25 comprises a snap-in lug 26, which extends radially around the closure part 16 and engages in a diametrically opposed snap-in opening 27 on the basic part 14.

It is essential that the closure part 16 together with the circuit board 20 or components 22 and together with the basic part 14 constitutes a modular system, i.e. that other closure parts 16 for other applications can also be used with one and the same basic part 14.

In addition, in the basic part 14 there are formed, for example, two through-openings 28, 29 through which connection elements 30, 31 are inserted. The connection elements 30, 31 serve to bring the circuit board 20 into electrical contact with electrically conductive regions 2, which are formed on the textile 1, by a frictional and/or interlocking connection. The electrically conductive regions 2 on the textile 1 are generally electrical conductive tracks which can, for example, be in the form of an electrically conductive yarn, and which are connected to the base material of the textile 1 by common connection techniques, e.g., by embroidery, weaving, printing, or in any other way.

In the exemplary embodiment shown in FIG. 1, the electrically conductive regions 2 are arranged on the top side of the textile 1 facing the main body 12. In the region of the through-openings 28, 29, the electrically conductive regions 2 have contact sites 3, 4, for example in the form of pads, which are brought into contact with the connection elements 30, 31 in a frictional and/or interlocking manner.

The electrical connection elements 30, 31 can likewise be formed in many different ways, for example in the form of pins, springs, insulation piercing connection devices, or the like. It is merely essential that the connection elements 30, 31 ensure electrical contact between the component 10 or circuit board 20 and the electrically conductive regions 2 on the textile 1.

Figure 2A:
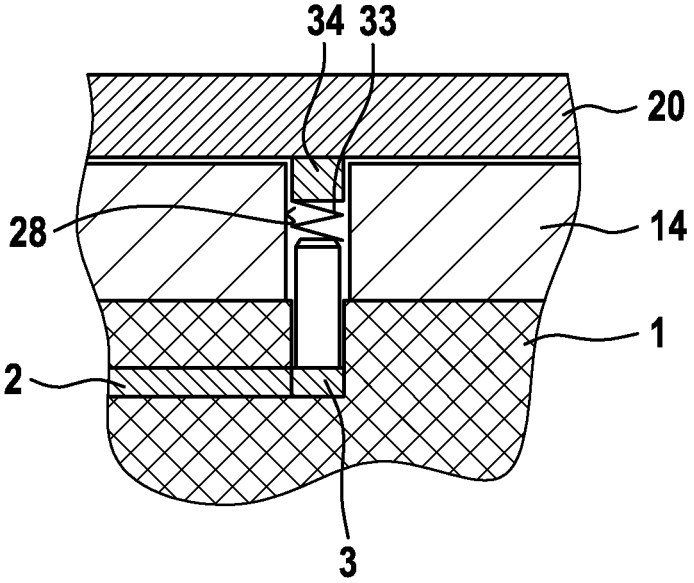
FIG. 2A to FIG. 2C show different electrical contacts between a connection element and an electrically conductive region of the textile, in accordance with the present invention.

According to FIG. 2A, it is provided, for example, that the connection element 30 has a pin 32 connected to a compression spring 33. The compression spring 33 is in turn rigidly connected to the circuit board 20 by way of an element 34, for example by a soldered connection or press-fit connection. The pin 32 is forced by the compression spring 33 in the direction of the contact site 3, where it is in abutment under spring preloading. In the example shown in FIG. 2A, the electrically conductive region 2 is arranged within the textile 1, i.e. at a distance from the basic part 14.

In a modification (not shown) of the example in FIG. 2A, it can be provided that the pin 32 is rigidly connected to the contact site 3 or is formed monolithically together with the contact site 3 and protrudes into the through-opening 28. Here, the end face, facing the pin 32, of the compression spring 33 abuts the pin 32 under spring preloading.

Figure 2B:
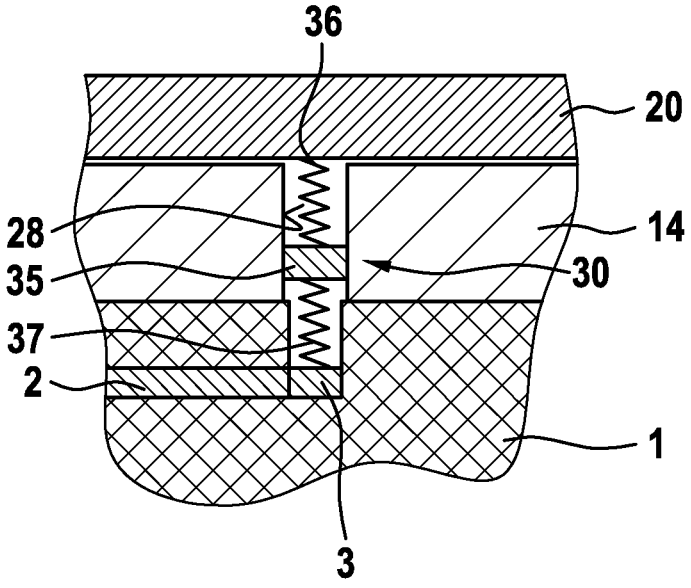

FIG. 2B shows that the connection element 30 has a plate 35, which is arranged in the through-hole 28 while forming a press-fit and on the opposite end faces of which there are arranged two compression springs 36, 37, which abut the circuit board 20 or the contact site 3 under spring preloading.

Figure 2C:
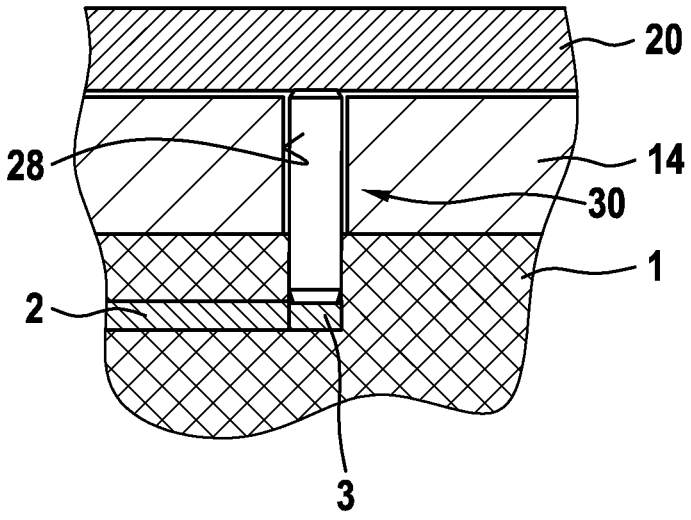

FIG. 2C shows that the pin-like connection element 30 is directly rigidly connected to the region 2 or the contact site 3. The connection element passes through the through-opening 28 and abuts the circuit board 20 under axial preloading. The preloading is ensured by a corresponding length of the connection element 30, said length being greater than the thickness of the basic part 14 in the region of the through-opening 28 such that, when the connection element 30 abuts the circuit board 20, it is pushed slightly in the direction of the textile 1.

There are also various options for connecting the component 10 to the textile 1. By way of example, FIG. 1 shows that the component 10 is part of a pushbutton 40, the component 10 forming the top part 41 of the pushbutton 40. For this purpose, a peg-like extension 42 is formed or molded on the basic part 14 on the side facing away from the closure part 16, said extension interacting with a plate-like element forming a bottom part 43 of the pushbutton 40. By way of example, the bottom part 43 is also plate-like and has the same cross-section as the basic part 14. In addition, it has a central opening 44, which is configured to form a snap-in connection 45 together with the extension 42.

The component 10 is assembled, and electrical contact thus established with the circuit board 20 on the textile 1, by connecting the bottom part 43 to the top part 41 of the pushbutton 40 while placing the textile 1 therebetween. In the process, the connection elements 30, 31 inevitably come into contact with the electrically conductive regions 2 of the textile 1.

It should be additionally noted that, as regards positioning or orienting the main body 12 precisely with respect to the textile 1, corresponding elements or measures must be provided depending on the contact location of the electrically conductive regions 2.

Figure 3:
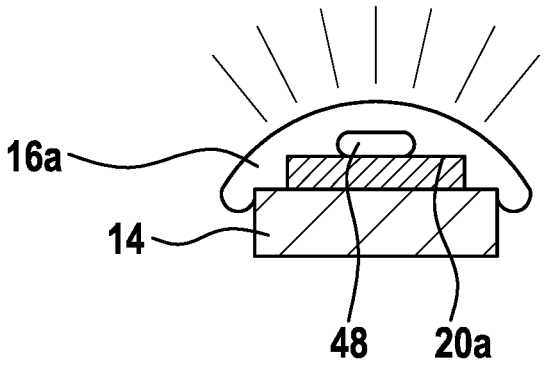
FIG. 3 is a simplified illustration of a cap-like closure part equipped with a lighting element, in accordance with the present invention.

FIG. 3 shows, in a highly simplified manner, that a lighting element 48 in the form of an LED is arranged on the top side of a circuit board 20*a*. In addition, the material of the (cap-like) closure part 16*a* consists of a transparent plastics material so that, when the lamp 48 is activated, the component 10 or closure part 16*a* lets the light from the lighting element 48 pass through.

Figure 4:
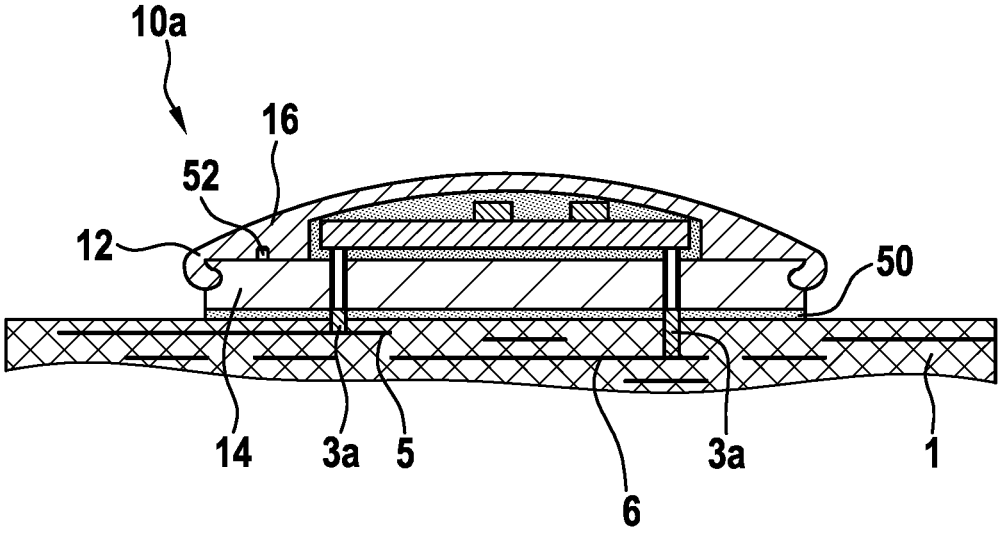
FIG. 4 and FIG. 5 are each sectional illustrations of components that have been modified compared with FIG. 1 and are directly connected to a textile.
Figure 5:
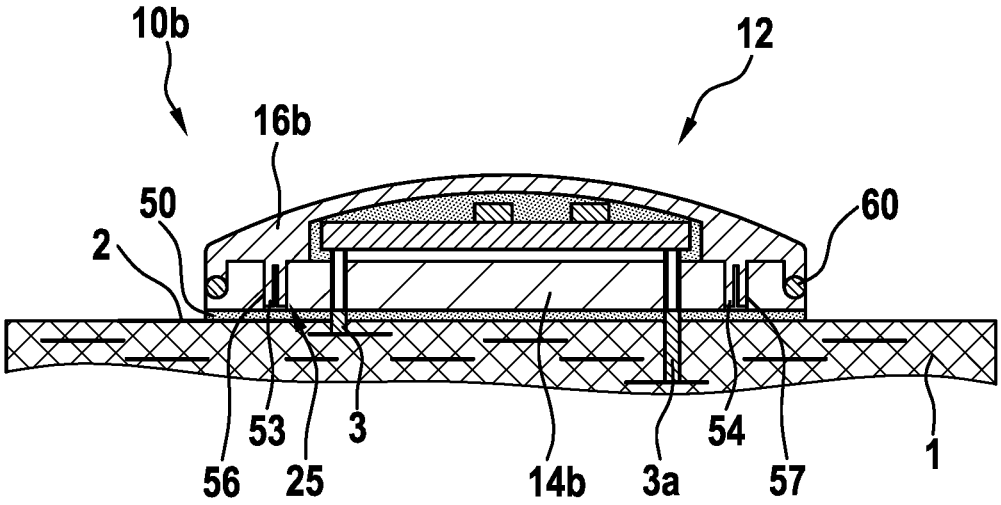

A common feature among the specific embodiments according to FIGS. 4 and 5 having the components 10*a* and 10*b* is that said components are not in the form of a pushbutton 40 but rather the main body 12 is directly connected to the textile 1 on the top side thereof, which faces the main body 12, by an integral bond 50. By way of example, the integral bond 50 can be an adhesive connection or a soldered connection. In addition, the two components 10*a*, 10*b* or the textile 1 share the feature whereby electrically conductive regions 5, 6 are provided inside the textile 1, arranged at different heights or in different planes inside the textile 1.

The component 10*a* according to FIG. 4 substantially corresponds to the component 10 according to FIG. 1. By contrast, however, it can be seen that the two electrically conductive regions 5, 6 on the textile 1 each have a contact region 3*a* which bridges the distance between the electrically conductive region 5, 6 and the plane of the top side of the textile 1 or the plane of the basic part 14. It can also be seen that an anti-rotation device 52, for example in the form of a pin, is arranged between the basic part 14 and the closure part 16.

The component 10*b* according to FIG. 5 also has a snap-in connection 25 between the basic part 14*b* and the closure part 16*b*, but for this purpose the closure part 16*b* has insertion pins 53, 54 which protrude into corresponding openings 56, 57 in the basic part 14*b* in order to create the snap-in connection 25. Furthermore, a radially circumferential seal 60, for example in the form of an adhesive bead or a sealing ring, is arranged between the basic part 14*b* and the closure part 16*b*.

What is claimed is:

1. A component for establishing electrical contact between at least one functional element and a textile, comprising:

a main body which accommodates at least one electrical component or one functional element; and connection elements configured to establish electrical contact with electrically conductive regions of the textile, the connection elements being configured, when the main body is connected to the textile, to create an electrical connection to the electrically conductive regions of the textile by a frictional or interlocking connection, wherein the connection elements have at least one element, which is configured to generate a resilient preload force in a direction of the electrically conductive regions of the textile.

2. The component as recited in claim 1, wherein the textile or the like is a functional support made of a flexible material.

3. The component as recited in claim 1, wherein the main body has through-openings for guiding the connection elements.

4. The component as recited in claim 3, wherein the connection elements protrude out of the through-openings on an underside of the main body.

5. The component as recited in claim 3, wherein the main body has a part in the form of a plate, which has a round cross-section and is made of electrically non-conductive material and a top side of which is covered by a cap-like closure part, the closure part being connected to the basic part by way of a snap-in connection.

6. The component as recited in claim 5, wherein a seat for arranging the electrical component or the functional element is formed in the closure part.

7. The component as recited in claim 5, wherein the closure part is made of transparent plastics material, and a lighting element is arranged in the main body.

8. The component as recited in claim 7, wherein the lighting element is an LED.

9. The component as recited in claim 1, wherein the main body is formed as a top part of a pushbutton, the top part being connectible to a bottom part of the pushbutton while forming a snap-in connection, wherein, in a connected state, a gap for securing the textile having the electrically conductive regions is formed between the top part and the bottom part.

10. The component as recited in claim 1, wherein the main body is configured to be connected to the textile or the like having the electrically conductive regions by way of an integral bond.

11. An assembly, comprising:

a component for establishing electrical contact between at least one functional element and a textile, including:

a main body which accommodates at least one electrical component or one functional element, and connection elements configured to establish electrical contact with electrically conductive regions of the textile or the like;

wherein the electrically conductive regions are brought into contact with the component by a frictional or interlocking connection by way of the connection elements, wherein the connection elements have at least one element, which is configured to generate a resilient preload force in a direction of the electrically conductive regions of the textile.

12. The assembly as recited in claim 11, wherein the textile is a functional support made of a flexible material.

13. The assembly as recited in claim 11, wherein the conductive regions are arranged on the textile in different planes and at different distances from the main body of the component.

14. The assembly as recited in claim 13, wherein the electrically conductive regions of the textile are connected to contact sites or are formed as contact sites that interact with the connection elements of the component, and the contact sites are of different lengths such that the contact sites on a side facing the component terminate in a shared plane.

15. The assembly as recited in claim 11, wherein the electrically conductive regions are arranged on a surface of the textile that faces the main body, and the electrically conductive regions are connected to the main body of the component by way of an electrically conductive adhesive or a layer of solder as an integral bond.

* * * * *